United States Patent [19]

Sawada et al.

[11] 4,337,935

[45] Jul. 6, 1982

[54] COPYING APPARATUS HAVING A MANUAL INSERTION PAPER FEEDING MECHANISM

[75] Inventors: Takamasa Sawada, Yokohama; Yoshiaki Sone, Tokyo; Kanou Tanaka, Yokohama, all of Japan

[73] Assignee: Canon Kabushiki Kaisha, Tokyo, Japan

[21] Appl. No.: 151,691

[22] Filed: May 20, 1980

[30] Foreign Application Priority Data

May 24, 1979 [JP] Japan ..... 54-63240

[51] Int. Cl.[3] ..... B65H 7/02

[52] U.S. Cl. ..... 271/9; 271/227; 271/242

[58] Field of Search ..... 271/9, 227, 242, 243

[56] References Cited

U.S. PATENT DOCUMENTS 3,598,396 8/1971 Andrews ..... 271/9
3,809,389 5/1974 Wirz ..... 271/243 X
3,817,515 6/1974 Kanda ..... 271/9
3,980,295 9/1976 Kleid ..... 271/242
4,052,054 10/1977 Cardwell ..... 271/227

*Primary Examiner*—Richard A. Schacher
*Attorney, Agent, or Firm*—Fitzpatrick, Cella, Harper & Scinto

[57] ABSTRACT

A copying apparatus has a manual insertion paper feeding mechanism having a manual insertion portion discrete from an insertion portion through which normally used paper may be inserted for conveyance thereof, register device for once stopping paper inserted through the manual insertion portion and thereafter conveying the paper at an adjusted timing, and slip feeder provided between the manual insertion portion and the register device for effecting forward feeding of the paper inserted through the manual insertion portion and for effecting slip feeding of the paper while maintaining the forward feeding condition when the forward movement of the paper is stopped by stoppage of the register device.

5 Claims, 5 Drawing Figures

COPYING APPARATUS HAVING A MANUAL INSERTION PAPER FEEDING MECHANISM

BACKGROUND OF THE INVENTION

1. Field of the Invention

This invention relates to a copying apparatus having a manual insertion paper feeding mechanism.

2. Description of the Prior Art

In copying apparatus, especially electrophotographic copying apparatus, copying is normally effected by paper contained within the apparatus being automatically fed on the basis of the copying operation. However, in response to the from-time-to-time requirement for copying to be effected on paper of other sizes than the sizes of paper contained within the apparatus, or on paper of different qualities, or on the back side of the paper whose front surface has already been subjected to copying, there have recently been developed copying apparatus having a manual insertion mechanism which permits copy paper to be inserted manually and independently into the apparatus. However, in a case where paper is automatically fed from an automatic paper feeding mechanism such as a cassette or the like, all the feeding operation is carried out mechanically and is therefore regularized, whereas in a case where paper is manually inserted into the apparatus, excess and deficiency of the amount of feed of paper or oblique insertion of paper may occur at random and the manual insertion of paper may often be unsuccessful.

SUMMARY OF THE INVENTION

It is therefore an object of the present invention to ensure manually inserted paper to be properly fed to feed standard rollers in the same manner as mechanically fed paper without oblique movement of the paper, thereby enabling manual insertion paper feed to be accomplished smoothly and efficiently.

The present invention consists in a copying apparatus having a manual insertion paper feeding mechanism having a manual insertion portion discrete from an insertion portion through which normally used paper may be inserted for conveyance thereof, register means for once stopping paper inserted through said manual insertion portion and thereafter conveying said paper at an adjusted timing, and slip feed means provided between said manual insertion portion and said register means for effecting forward feeding of the paper inserted through said manual insertion portion and for effecting slip feeding of said paper while maintaining the forward feeding condition when the forward movement of said paper is stopped by stoppage of said register means.

The invention will become fully apparent from the following detailed description thereof taken in conjunction with the accompanying drawings.

DESCRIPTION OF THE PREFERRED EMBODIMENTS

Figure 1:
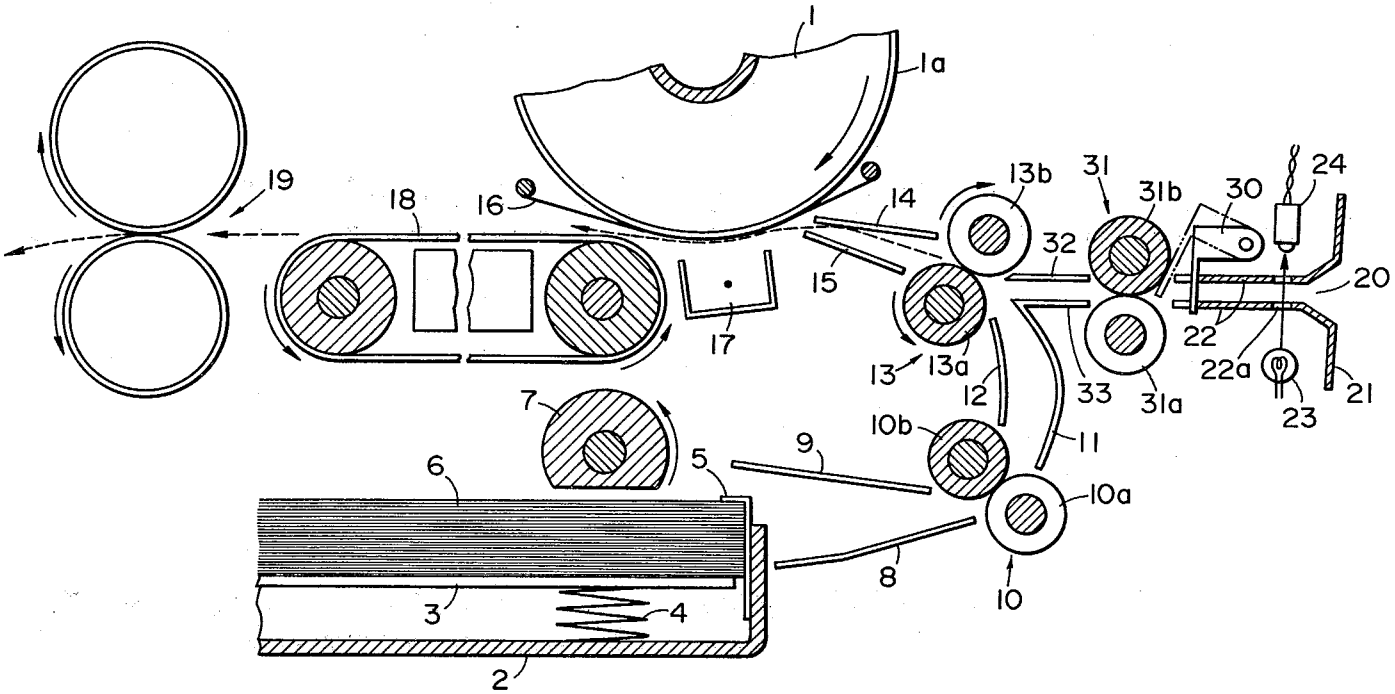
FIG. 1 is a vertical cross-sectional view showing essential portions of a copying apparatus of the cassette paper feeding type equipped with the mechanism of the present invention.

Referring to FIG. 1 which is a cross-sectional view showing essential portions of an electrophotographic copying apparatus to which the present invention is applied, reference numeral 1 designates a well-known photosensitive drum having a photoconductive layer 1*a* and rotatable in the direction of arrow. Latent image formation means, developing means and cleaning means for removing any remnant toner after image transfer are not shown. Sheet members to be conveyed in synchronism with the image on the photosensitive drum 1 are piled on an intermediate bottom plate 3 of a conventional automatic paper feeding mechanism such as a lower cassette or paper feeding bed 2. The intermediate bottom plate 3 is upwardly biased by a spring 3 and the height of the sheet members 6 is maintained constant by a separating pawl 5. The sheet members 6 are fed one by one from the cassette by a pick-up roller 7 making one complete rotation, the pick-up roller 7 having a circumferential portion thereof cut away. The sheet member 6 thus fed is guided by guide plates 8 and 9 and further guided through slip conveyor means 10 and by guide plates 11 and 12 and passes to register rollers 13. With its oblique movement corrected by a construction to be described, the sheet member passes to the photosensitive drum 1 with the air of guide plates 14 and 15, and a potential is imparted to the sheet member by the discharge from a corona discharger 17, whereafter the toner image on the photosensitive drum 1 is transferred to the sheet member. A separating belt 16 is mounted at an axial end of the photosensitive drum 1 and lies between the photosensitive drum 1 and an end portion of the sheet member 6. After the image transfer, the sheet member is separated from the drum 1 by the belt 16 and conveyed to fixing means 19 by conveyor belt means 18 having a suction mechanism. At the fixing means 19, the transferred image on the sheet member is fixed, and then the sheet member is discharged out of the apparatus.

Figure 2:
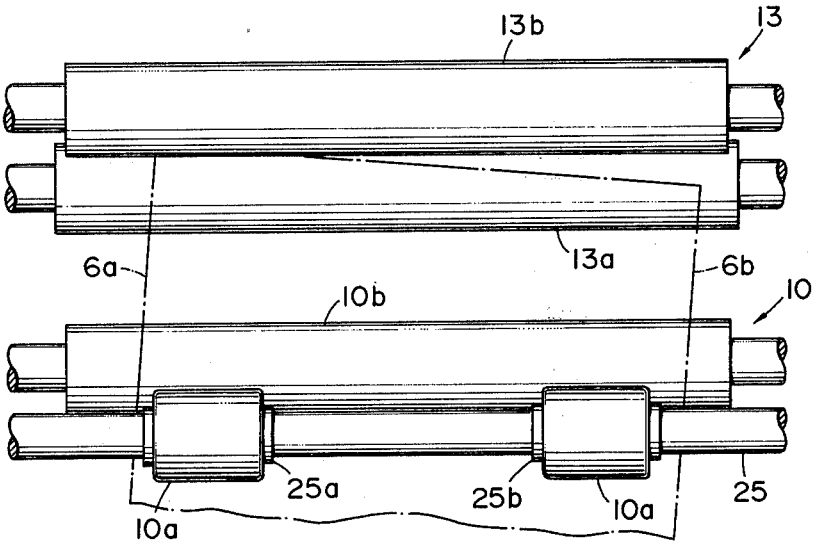
FIG. 2 is a front view showing the arrangement of rollers.

Correction of the aforementioned oblique movement of the sheet member will now be described in detail. In FIG. 1, the sheet member 6 fed by the pick-up roller 7 is conveyed until it is nipped between a pair of rollers 10*a* and 10*b* forming the slip conveyor means 10. The surface of the roller 10*b* is formed of a material of relatively high friction coefficient such as rubber or the like, and the roller 10*b* is always driven by drive means during the conveyance of the sheet member. The roller 10*a* opposed to the roller 10*b* comprises one or more rollers of a narrow width in the direction of the axis of rotation, as shown in FIG. 2, and is rotatably mounted on a shaft 22. These rollers 10*a* and 10*b* serve to transport the sheet member 6, fed by the pick-up roller 7, to the register rollers 13 while rotating with the sheet member 6 nipped therebetween.

The register rollers 13 are stopped for a time necessary to convey the sheet member in synchronism with the photosensitive drum 1, and start to rotate by a synchronous signal. The roller 13*a* of the rollers 13 is a drive roller against which the follower roller 13*b* is lightly urged. These rollers 13*a* and 13*b* are formed of a material of high friction coefficient such as rubber or the like, and the surface thereof is formed of a material of low friction coefficient such as metal or resin so as to permit the conveyed sheet member to be well nipped between the rollers.

With the above-described construction, when the leading end edge of the sheet member 6 strikes against and between the register rollers 13*a* and 13*b*, these rollers are not yet in rotation and the sheet member does not advance. The sheet member is then driven by one roller 10*b* of the slip conveyor rollers 10, but the other roller 10*a* only makes a slip and therefore, the sheet member stops without advancing or forming a loop. However, when the sheet member 6 strikes against the register rollers 13 in an oblique state as indicated by dot-and-dash line in FIG. 2, the roller 10*a* makes a slip and does not effect its feeding action on the advanced side 6*a* of the sheet member, while the roller 10*a* effects its feeding action on the delayed side 6*b* of the sheet member and therefore, the sheet member is further conveyed by an amount corresponding to that delay and thus, with the sheet member nipped between the rollers 10*a* and 10*b*, the oblique movement of the sheet member is corrected so that the leading end edge thereof becomes parallel to the axes of the rollers 13. Then, when the register rollers 13 start to rotate by a timing signal, the sheet member is conveyed with the leading end edge thereof parallel to the rollers 13 and with the trailing end portion thereof nipped between the rollers 10*a* and 10*b* and thus, the sheet member can thereafter be conveyed without oblique movement. Further, this effect can sufficiently prevent occurrence of any subsequent oblique movement of the sheet member because the guide plate 11 for the sheet member is sharply curved as shown in the embodiment of FIG. 1 and the sheet member is conveyed while sliding frictionally with respect to such guide member.

FIG. 2 is a front view taken in the direction of arrow A in the apparatus of FIG. 1 and showing the construction of each roller. In the case of the present embodiment, the rollers 10*a* of the slip conveyor means are mounted on a fixed shaft 25 at two left and right locations with stops 25*a* and 25*b* interposed therebetween, as shown.

Figure 3:
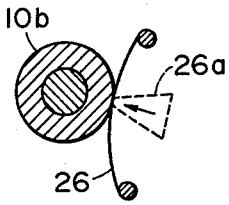
FIGS. 3, 4 and 5 are cross-sectional views showing modified forms of slip conveyor means.
Figure 4:
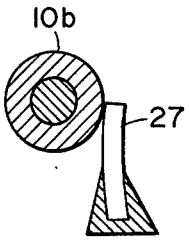
Figure 5:
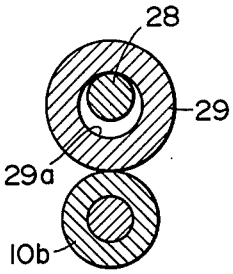

FIGS. 3 to 5 show further embodiments of the slip conveyor means. In these Figures, 10*b* is identical to the drive roller 10*b* of FIG. 1. The embodiment of FIG. 3 is one which utilizes a plate spring 26 in place of the follower roller 10*a* of FIG. 1. The plate spring 26 may be replaced by a pin-like spring, or a film-like belt such as the separating belt 16 of FIG. 1 may be extended or a member 26*a* as indicated by broken line may be urged against the belt to thereby adjust the effect of slip and conveyance. The embodiment of FIG. 4 is one in which a resilient plate 27 formed of resin is lightly urged against the drive roller 10*b*. The embodiment of FIG. 5 is one in which a follower roller 29 mounted on a fixed shaft 28 is urged against the drive roller 10*b* by the gravity of the roller 29. In this embodiment of FIG. 5, the roller 29 having a central bore 29 of a larger diameter than that of the fixed shaft 28 is mounted on the shaft.

The above-described effect can also be obtained in each of the slip conveyor means of the above-described embodiments, and the number of such means is not limited to two, but may be one or three or more.

The present invention provides a manual paper feeding mechanism in a copying apparatus having an interior automatic paper feeding mechanism as described above.

In FIG. 1, reference numeral 20 designates a manual insertion port provided in a side plate 21 of the copying apparatus body, reference numeral 22 denotes a paper guide leading to the manual insertion port 20, and reference numerals 23, 24 and 22*a* designate a paper detecting device which, in the shown embodiment, comprises a lamp 23 for projecting light through a hole 22*a* in the guide 22 and a light-receiving element 24. Alternatively, the paper detecting device may comprise a paper switch, for example. Designated by 30 is a gate provided in the guide 22 and adapted to be opened and closed through an electromagnetic mechanism, not shown. Designated by 31 is conveyor means entirely functionally similar to the aforementioned slip conveyor means 10, and 31*a* and 31*b* correspond to 10*a* and 10*b*, respectively. Denoted by 32 and 33 are paper guides.

When a sheet of copy paper is inserted through the manual insertion port 20 until it strikes against the gate 30, paper feed display is effected by an electrical signal from the detecting means 23, 24. When the operator depresses a manual insertion print button after looking at the display, the mode of the automatic feeding electric circuit from the cassette 2 is changed over to the manual insertion feeding mode and the gate 30 is opened by that signal while the feed rollers 31 start to rotate. The electric circuit change-over means is not shown, because a conventional control circuit is used as such means. When the copy paper is further inserted, it is nipped between the feed rollers 31 and strikes against the register rollers 13, whereby correction of the oblique movement of the copy paper is effected in the same manner as previously described and the copy paper stands by. If pronounced oblique movement or other improper condition of the copy paper is found during this stand-by, the copy paper may be withdrawn and re-inserted.

When the operator depresses a print button after the time required for the correction of the oblique movement has passed, the register rollers 13 are driven to advance the copy paper and complete a copying operation, whereafter the electric circuit is changed over to the automatic feeding mode.

As described above, also in the case of the manual insertion paper feeding, correction of oblique movement of the copy paper is automatically carried out as in the case of the automatic paper feeding and thus, the manual insertion copying in which irregularity of paper insertion is unavoidable can also be accomplished smoothly and efficiently with oblique movement trouble being eliminated.

In the aforementioned manual insertion mechanism portion, if design is made such that the rotation of the feed rollers 31 is started by the signal from the detecting means 23, 24 and that copy paper is manually fed until it strikes against the rollers 31, the operation of once stopping the paper in front of the gate 30 and then depressing the manual insertion print button may be eliminated. Also, the gate 30 may be eliminated.

I claim:

1. A copying apparatus having a manual insertion paper feeding mechanism comprising:

a manual insertion portion discrete from an insertion portion through which normally used paper may be inserted for conveyance thereof;

register means for once stopping paper inserted through said manual insertion portion and for thereafter conveying said paper at an adjusted timing; and slip feed means provided between said manual insertion portion and said register means for effecting forward feeding of the paper inserted through said manual insertion portion and for allowing the respective transverse edges of said paper to slip while maintaining the forward feeding condition when the forward movement of said paper aligned with such respective transverse edges is stopped by stoppage of said register means.

2. A copying apparatus according to claim 1, wherein said feeding mechanism further includes detector means for detecting the insertion of the paper and a gate responsive to a signal from said detector means for being opened and closed, and wherein said detector means and said gate are provided between said manual insertion portion and said slip feed means.

3. A copying apparatus according to claim 1, wherein said register means serves also as means for controlling of the timing of the normally used paper.

4. A copying apparatus according to claim 3, further comprising additional slip feed means, wherein said normally used paper is directed to said register means through said additional slip feed means.

5. A copying apparatus according to claim 2, wherein said slip feed means is caused to start operating in response to the detection signal of said detector means.

* * * * *